US006649575B2

(12) United States Patent
Robson

(10) Patent No.: US 6,649,575 B2
(45) Date of Patent: Nov. 18, 2003

(54) LUBRICATING OIL COMPOSITIONS

(75) Inventor: Robert Robson, Oxfordshire (GB)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 10/007,514

(22) Filed: Dec. 5, 2001

(65) Prior Publication Data

US 2002/0107152 A1 Aug. 8, 2002

(30) Foreign Application Priority Data

Dec. 7, 2000 (EP) ..... 00204368

(51) Int. Cl.[7] ..... C10M 141/10

(52) U.S. Cl. ..... 508/294; 508/291; 508/375; 508/376; 508/380; 508/390; 508/408

(58) Field of Search ..... 508/291, 294, 508/375, 376, 380, 390, 408, 460

(56) References Cited

U.S. PATENT DOCUMENTS

| | | | | |
|---|---|---|---|---|
| 4,029,587 A | | 6/1977 | Koch | 252/48.2 |
| 4,957,649 A | | 9/1990 | Ripple et al. | 252/32.7 E |
| 5,569,405 A | * | 10/1996 | Nakazato et al. | 508/192 |
| 5,622,923 A | * | 4/1997 | Mathur et al. | 508/431 |
| 5,629,272 A | * | 5/1997 | Nakazato et al. | 508/185 |
| 5,719,107 A | * | 2/1998 | Outten et al. | 508/185 |
| 5,958,848 A | * | 9/1999 | Robson | 508/232 |
| 5,965,497 A | * | 10/1999 | Adams et al. | 508/287 |
| 6,004,910 A | * | 12/1999 | Bloch et al. | 508/294 |
| 6,451,745 B1 | * | 9/2002 | Ward | 508/192 |

FOREIGN PATENT DOCUMENTS

| | | | |
|---|---|---|---|
| EP | 0 277 729 A1 | 8/1988 | C10M/163/00 |
| EP | 0 652 279 A1 | 5/1995 | C10M/163/00 |
| EP | 0 684 298 A2 | 11/1995 | C10M/141/12 |
| WO | WO96/39478 | 12/1996 | C10M/169/04 |

* cited by examiner

*Primary Examiner*—Jacqueline V. Howard

(57) ABSTRACT

A low-phosphorus lubricant comprises:

an oil of lubricating viscosity;

a nitrogen-containing and a nitrogen-free dispersant;

a metal dihydrocarbyl dithiophosphate; and a hydrocarbyl-substituted carboxylic acid derivative, the ratio of the dispersants being such as to provide suitable fluoroelastomer seal compatibility.

15 Claims, No Drawings

LUBRICATING OIL COMPOSITIONS

The present invention relates to crankcase lubricating oil compositions. More particularly, the present invention relates to such compositions which have relatively low levels of phosphorus and sulfur and exhibit acceptable compatibility with the Viton® fluoroelastomer seals used in internal combustion engines.

Zinc dihydrocarbyl dithiophosphates (ZDDP's) have been the principal antiwear additives in the lubricating oil field and are normally used such that the finished oil will have a phosphorus-content of about 0.1% by weight or higher in order to meet industry performance tests for wear reduction. Another advantage of ZDDP's has been their ability to contribute to the compatibility of the lubricant with fluorocarbon elastomers, such as those referred to as Viton® elastomers. To comply with regulations and manufacturers' specifications, the trend in the lubricating oil industry is to reduce the amount of both phosphorus and sulfur in crankcase lubricants in order to improve the durability of exhaust gas after-treatment systems. ZDDP's, which contains both these elements, are a major contributor of both phosphorus and sulfur in lubricating oil compositions.

A problem in formulating lubricating oil compositions that contain low levels of ZDDP and corresponding low levels of phosphorus and sulfur is the consequent adverse performance in the Volkswagen Viton® seal compatibility test, specifically the Volkswagen PV 3344 Seal Test, which is currently considered the most difficult fluoroelastomer seal compatibility test applicable to commercial lubricating oils. The present invention ameliorates the problem, as evidenced by the data provided herein, by using a nitrogen-containing lubricating oil dispersant in combination with a nitrogen-free lubricating oil dispersant, as well as a hydrocarbyl-substituted carboxylic acid or derivative thereof such as an anhydride.

EP-A-0 277 729 describes lubricating oils having a phosphorus content not greater than 0.1 wt 1%. Such oils are not described as containing nitrogen-free dispersants or hydrocarbyl-substituted carboxylic acids or derivatives thereof, nor are their fluoroelastmer seal compatibility properties addressed.

The present invention provides, in a first aspect, a crankcase lubricating oil composition comprising:

(A) an oil of lubricating viscosity, in a major amount;

(B) a nitrogen-containing lubricating oil dispersant, in a minor amount, such as 1.5 to 2 mass %;

(C) a nitrogen-free lubricating oil dispersant, in a minor amount, such as 1 to 1.5 mass %;

(D) a metal dihydrocarbyl dithiophosphate, in a minor amount, such as 0.25 to 0.8 mass %;

(E) a hydrocarbyl-substituted carboxylic acid or derivative thereof, such as an anhydride, in a minor amount such as 0.25 to 0.8 mass %; and (F) a metal detergent, in a minor amount such as 0.1 to 4 mass %, wherein the mass:mass ratio of (B) to (C) in the composition is 0:4:1 or greater, such as in the range from 10:1 to 0.4:1, and the composition contains 0.075 or less, preferably 0.06 or less, more preferably 0.05 or less, mass % of phosphorus, expressed as elemental phosphorus. The composition may be phosphorus-free or contain from 0.01, or from 0.02, mass % phosphorus.

In a second aspect, the invention provides the use of components (B) to (F), as defined in the first aspect of the invention, in a lubricating oil composition that contains 0.075 or less, preferably 0.06 or less, more preferably 0.05 or less, mass % phosphorus, expressed as elemental phosphorus, to improve the fluoroelastomer seal compatibility properties of the composition.

In a third aspect, the invention provides a method of lubricating an internal combustion engine equipped with an exhaust gas after treatment system which comprises supplying to the engine a lubricating oil composition according to the first aspect of the invention.

In this specification:

"Major amount" means in excess of 50 mass % of the composition.

"Minor amount" means less than 50 mass % of the composition, both in respect of the stated additive and in respect of the total mass % of all of the additives present in the composition, reckoned as active ingredient of the additive or additives.

"Comprises or comprising" or cognate words are taken to specify the presence of stated features, steps, integers, or components, but does not preclude the presence or addition of one or more other features, steps, integers, components or groups thereof.

"TBN" is Total Base Number as measured by ASTM D2896.

"Oil-soluble" or "oil-dispersible" do not necessarily indicate that the additives are soluble, dissolvable, miscible or capable of being suspended in the oil (A), in all proportions. They do mean, however, that they are, for example, soluble or stably dispersible in the oil to an extent sufficient to exert their intended effect in the environment in which the oil is employed. Moreover, the additional incorporation of other additives may also permit incorporation of higher levels of a particular additive, if desired.

All percentages reported are mass % on an active ingredient basis, i.e., without regard to carrier or diluent oil, unless otherwise stated.

It should be noted that the lubricating oil compositions of this invention comprise defined individual, i.e. separate, components that may or may not remain the same chemically before and after blending. Thus, it will be understood that the various components of the composition, essential as well as optimal and customary, may react under the conditions of formulation, storage or use, and that the invention also provides the product obtainable or obtained as a result of any such reaction.

The features of the invention will now be discussed in further detail as follows:

(A) Oil of Lubricating Viscosity

The oil of lubricating viscosity may be selected from a wide variety of base stocks including natural oils, synthetic oils, or mixtures thereof. Examples of suitable base stocks may be found in one or more of the base stock groups, or mixtures of said base stock groups, set forth in the American Petroleum Institute (API) publication "Engine Oil Licensing and Certification System", Industry Services Department, Fourteenth Edition, December 1996, Addendum 1, December 1998.

(a) Group I base stocks contain less than 90 percent saturates and/or greater than 0.03 percent sulfur and have a viscosity index greater than or equal to 80 and less than 120 using the test methods specified in Table A below.

b) Group II base stocks contain greater than or equal to 90 percent saturates and less than or equal to 0.03 percent sulfur and have a viscosity index greater than or equal to 80 and less than 120 using the test methods specified in Table A below.

c) Group III base stocks contain greater than or equal to 90 percent saturates and less than or equal to 0.03 percent sulfur and have a viscosity index greater than or equal to 120 using the test methods specified in Table A below.

d) Group IV base stocks are polyalphaolefins (PAO), a synthetic base stock.

e) Group V base stocks include all other base stocks not included in Groups I, II, III, or IV.

TABLE A

Analytical Methods for Testing Base Stocks

| Property | Test Method |
|---|---|
| Saturates | ASTM D2007 |
| Viscosity Index | ASTM D2270 |
| Sulfur | ASTM D2622, D4292, D4927, or D3120 |

The oil of lubricating viscosity used in this invention preferably should have a viscosity index of at least 95, preferably at least 100. Preferred oils are selected from those of Groups II, III and IV because of their low sulfur content.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers and chlorinated polybutylenes); poly(1-hexenes), poly(1-octenes), poly(1-decenes) and mixtures thereof; alkylbenzenes (e.g., dodecylbenzenes, tetradecylbenzenes, dinonylbenzenes and di-(2-ethylhexylbenzenes); polyphenyls (e.g., biphenyls, terphenyls and alkylated polyphenyls); alkylated diphenyl ethers and alkylated diphenyl sulfides and the derivatives, analogs and homologs thereof.

Alkylene oxide polymers and interpolymers and derivatives thereof where the terminal hydroxyl groups have been modified such as by esterification or etherification, constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of 500 to 1000 and diethyl ether of polypropylene glycol having a molecular weight of 1000 to 1500) or mono- and polycarboxylic esters thereof, for example, acetic acid esters, mixed $C_{3-8}$ fatty acid esters, or the $C_{13}$ Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids and alkenyl malonic acids) with a variety of alcohols (e.g., butyl alcohol, hexyl alcohol, dodecyl alcohol, 2-ethylhexyl alcohol, ethylene glycol, diethylene glycol monoether and propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer and the complex ester formed by reacting one mole of sebacic acid with two moles of tetraethylene glycol and two moles of 2-ethylhexanoic acid.

Esters useful as synthetic oils also include those made from C5 to C12 monocarboxylic acids and polyols and polyol ethers such as neopentyl glycol, trimethylol propane, pentaerythritol, dipentaerythritol and tripentaerythritol.

Silicon-based oils such as polyalkylpolyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl)silicate, hexyl-(4-methyl-2-pentoxy) disiloxane, poly(methyl)siloxanes and poly(methyl-phenyl) siloxanes). Other synthetic lubricating oils include liquid esters of phosphorus-containing acids (e.g., tricresyl phosphate, trioctyl phosphate and diethyl ester of decane phosphonic acid) and polymeric tetrahydrofurans.

Unrefined, refined and rerefined oils, either natural or synthetic (as well as mixtures of two or more of any of these) of the type disclosed hereinabove can be used in the compositions of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration and percolation. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

(B) Nitrogen-containing Lubricating Oil Dispersant

A wide variety of nitrogen-containing dispersants, typically ashless, can be used in this invention. They may be used in an amount of 1.5 to 2 mass %. Suitable nitrogen-containing dispersants are basic nitrogen compounds which must have a basic nitrogen content as measured by ASTM D-664 or D-2896. They are preferably oil-soluble. Typical of such dispersants are succinimides, carboxylic acid amides, hydrocarbyl monoamines, hydrocarbyl polyamines, Mannich bases, phosphoramides, thiophosphoramides, phosphonamides, dispersant viscosity index improvers, and mixtures thereof. These basic nitrogen-containing compounds are described below. Any of the nitrogen-containing dispersants may be after-treated using procedures known in the art so long as they continue to contain basic nitrogen. After-treatment may be accomplished by contacting the basic nitrogen-containing compound with the after-treating compound(s) concurrently or in any sequence. Suitable post-treating compounds include urea, thiourea, carbon disulfide, aldehydes, ketones, carboxylic acids, hydrocarbon-substituted succinic anhydrides, nitrites, epoxides, boron compounds, organic phosphorus compounds, inorganic phosphorus compounds (such as $H_3PO_3$ and $H_3PO_4$) and sulfur compounds, and mixtures thereof. These after-treatments are particularly applicable to succinimides and Mannich base.

The mono- and polysuccinimides that can be used as a dispersant in this invention are disclosed in numerous references and are well known in the art. Certain fundamental types of succinimides and the related materials encompassed by the term of art "succinimide" are described in U.S. Pat. Nos. 3,219,666; 3,172,892; and 3,272,746. The term "succinimide" is understood in the art to include many of the amide, imide, and amidine species which may also be formed. The predominant product, however, is a succinimide and this term has been generally accepted as meaning the product of a reaction of an alkenyl-substituted succinic acid or anhydride with a nitrogen-containing compound. Preferred succinimides, because of their commercial availability, are those succinimides prepared from a hydrocarbyl succinic anhydride, wherein the hydrocarbyl group contains from 60 to 350 carbon atoms, and an ethylene amine, said ethylene amines being especially characterized by ethylene diamine, diethylene triamine, triethylene tetramine, and tetraethylene pentamine. Particularly preferred are those succinimides prepared from polyisobutenyl succinic anhydride of 70 to 128 carbon atoms and tetraethylene pentamine or the so-called "polyamine bottoms" resulting from polyethyleneamine synthesis. These "polyamine bottoms" predominantly contain pentaethylene hexamine and tetraethylene pentamine and a lesser amount of lighter ethylene polyamines and cyclic condensation products containing piperazine rings.

Also included within the term "succinimide" are the cooligomers of a hydrocarbyl succinic acid or anhydride and a poly secondary amine containing at least one tertiary amino nitrogen in addition to two or more secondary amino groups. Ordinarily this composition has between 1,500 and 50,000 number average molecular weight (Mn). A typical compound would be that prepared by reacting polyisobutenyl succinic anhydride and ethylene dipiperazine.

Carboxylic acid amides are also suitable dispersants. Typical are those disclosed in U.S. Pat. No. 3,405,064. These are ordinarily prepared by reacting a carboxylic acid or anhydride or ester thereof, having at least 12 to 350 aliphatic carbon atoms in the principal aliphatic chain and, if desired, having sufficient pendant aliphatic groups to render the molecule oil-soluble, with an amine or a hydrocarbyl polyamine, such as an ethylene amine, to give a mono- or polycarboxylic acid amide. Preferred are those amides prepared from (1) a carboxylic acid of the formula $R_ZCOOH$, where $R_Z$ is $C_{12}$ to $C_{20}$ alkyl or a polyisobutenyl carboxylic acid in which the polyisobutenyl group contains from 64 to 128 carbon atoms, and (2) an ethylene amine, especially triethylene tetramine or tetraethylene pentamine or mixture thereof.

Another class of compounds useful for supplying basic nitrogen-containing dispersants are Mannich bases. These may be prepared from a phenol or $C_9$ to $C_{200}$ alkylphenol, an aldehyde, such as formaldehyde or formaldehyde precursor such as paraformaldehyde, and an amine compound. The amine may be a mono- or polyamine, and they are typically prepared from an alkylamine, such as methylamine or an ethylene amine, such as diethylene triamine, or tetraethylene pentamine. The phenolic material may be sulfurized and preferably is dodecylphenol or a $C_{80}$ to $C_{100}$ alkylphenol. Typical Mannich bases which can be used in this invention are disclosed in U.S. Pat. Nos. 4,157,309; 3,649,229; 3,368,972; and 3,539,663. The last referenced patent discloses Mannich bases prepared by reacting an alkylphenol having at least 50 carbon atoms, preferably 50 to 200 carbon atoms, with formaldehyde and an alkylene polyamine $HN(ANH)_nH$ where A is a saturated divalent alkyl hydrocarbon of 2 to 6 carbon atoms and n is 1 to 10 and where the condensation product of said alkylene polyamine may be further reacted with urea or thiourea. The utility of these Mannich bases as starting materials for preparing lubricating oil additives can often be significantly improved by treating the Mannich base using conventional techniques to introduce boron into the composition.

Preferred nitrogen-containing dispersants for use in this invention are succinimides, carboxylic acid amides, and Mannich bases with borated succinimides being particularly preferred, especially succinimides having polyisobutenyl substituents having a number average molecular weight between about 700 and about 5,000, more preferably 950 to 2,500.

(C) Nitrogen-free Lubricating Oil Dispersant

The nitrogen-free ashless dispersants, include, for example, alkenyl succinic acid esters of alcohols containing 1 to 20 carbon atoms and 1 to 6 hydroxyl groups. "Esters" can include mono- or polyesters and also partial esters. Representative examples are described in U.S. Pat. Nos. 3,331,776; 3,381,022; and 3,522,179. The alkenyl succinic portion of these esters corresponds to the alkenyl succinic portion of the succinimides described above including the same preferred and most preferred subgenus, e.g., alkenyl succinic acids and anhydrides, where the alkenyl group contains at least 30 carbon atoms and notably, polyisobutenyl succinic acids and anhydrides wherein the polyisobutenyl group has a number average molecular weight of 500 to 5,000, preferably 700 to 2,500, more preferably 700 to 1,400, and especially 800 to 1,200. As in the case of the succinimides, the alkenyl group can be hydrogenated or subjected to other reactions involving olefinic double bonds. These dispersants may be present, for example, in amounts of 1 to 1.5 mass %.

Alcohols useful in preparing the esters include methanol, ethanol, 2-methylpropanol, octadecanol, eicosanol, ethylene glycol, diethylene glycol, tetraethylene glycol, diethylene glycol monoethylether, propylene glycol, tripropylene glycol, glycerol, sorbitol, 1,1,1-trimethylol ethane, 1,1,1-trimethylol propane, 1,1,1-trimethylol butane, pentaerythritol and dipentaerythritol.

The succinic esters are readily made by merely heating a mixture of alkenyl succinic acid, anhydride or lower alkyl (e.g., $C_1$ to $C_4$) ester with the alcohol while distilling out water or lower alkanol. In the case of acid-esters, less alcohol is used. In fact, acid-esters made from alkenyl succinic anhydrides do not evolve water. In another method the alkenyl succinic acid or anhydrides can be merely reacted with an appropriate alkylene oxide such as ethylene oxide, propylene oxide, and the like, including mixtures thereof.

As stated, the mass:mass ratio of (B) to (C) is 0.4:1 or greater such as in the range from 10:1 to 0.4:1. Preferably, the range is from 9:1 to 0.4:1, such as 8:1 to 0.5:1.

(D) Metal Dihydrocarbyl Dithiophosphate

The metal is preferably zinc. The dihydrocarbyldithiophosphate may be present in amount of 0.25 to 0.8, preferably 0.5 to 0.7, mass %, in the lubricating oil composition. Preferably, zinc dialkylthiophosphate (ZDDP) is used. This provides antioxidant and antiwear properties to the lubricating composition. Such compounds may be prepared in accordance with known techniques by first forming a dithiophosphoric acid, usually by reaction of an alcohol or a phenol with $P_2S_5$ and then neutralizing the dithiophosphoric acid with a suitable zinc compound. Mixtures of alcohols may be used including mixtures of primary and secondary alcohols. Examples of such alcohols include, but are not restricted to the following list: iso-propanol, iso-octanol, 2-butanol, methyl isobutyl carbinol (4-methyl-1-pentane-2-ol), 1-pentanol, 2-methyl butanol, and 2-methyl-1-propanol. The hydrocarbyl groups can be a primary, secondary, or mixtures thereof, e.g. the compounds may contains primary and/or secondary alkyl groups derived from primary or secondary carbon atoms. Moreover, when employed, there is preferably at least 50, more preferably 75 or more, most preferably 85 to 100, mass % secondary alkyl groups; an example is a ZDDP having 85 mass % secondary alkyl groups and 15 mass % primary alkyl groups, such as a ZDDP made from 85 mass % butan-2-ol and 15 mass % iso-octanol.

The metal dihydrocarbyldithiophosphate provides most if not all, of the phosphorus content of the lubricating oil composition. Amounts are present in the lubricating oil composition to provide a phosphorus content, expressed as mass % elemental phosphorus, of 0.075 or less, preferably 0.06 or less, more preferably 0.05 or less, such as in the range of 0.025 to 0.04.

(E) Hydrocarbyl-substituted Carboxylic Acids or Derivatives Thereof

These are preferably of poly- such as dicarboxylic acids, such as succinic acid and homologues thereof. The derivative is preferably an acid anhydride.

The hydrocarbyl substitutent group may contain an average of at least 8, or 30, or 35 to 350, or to 200, or to 100, carbon atoms. The hydrocarbyl group may have a number average molecular weight of 450 to 5000 or to 2200, preferably 950 to 1300.

The hydrocarbyl group is typically an olefin polymer (or polyalkene), especially a polymer comprising a major molar amount (i.e. greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil-soluable polymeric hydrocarbon backbone may be a homopolymer (e.g. polypropylene or polyisobutylene) or a copolymer of two or more of such olefins (e.g. copolymers of ethylene and an alpha-olefin such as propylene and butylene or copolymers of two different alpha-olefins). Other copolymers include those in which a minor molar amount of the copolymer monomers, e.g., 1 to 10 mole %, is a $C_3$ to $C_{22}$ non-conjugated dielefin (e.g., a copolymer of isobutylene and butadiene, or a copolymer of ethylene, propylene and 1,4-hexadiene or 5-ethylidenne-2-norbornene).

One preferred class of olefin polymers is polybutenes and specifically polyisobutenes (PIB) or poly-n-butenes, such as amy be prepared by polymerization of a $C_4$ refinery stream.

Another class of olefin polymers is ethylene alpha-olefin (EAO) copolymers or alpha-olefin homo- and copolymers having in each case a high degree (e.g. greater than 30%) of terminal vinylidene unsaturation.

A preferred example of (E) is a succinic acid or anhydride. These preferred products may be prepared by known functionalisation reactions which include: halogenation of the polymer at an olefinic bond and subsequent reaction of the halogenated polymer with maleic acid or anyhdride; and reaction of the polymer with maleic acid or anyhdride by the "ene" reaction in the absence of halogenation. Particulary preferred succinic anhydrides are those with a polyisobutenyl backbone, typically having an $\overline{M}n$ of from 700 to 2500, for example 900 to 1100. (E) may be present in an amount from 0.3 to 0.4 mass % based on the mass of the composition.

(F) Metal Detergent

Metal-containing or ash-forming detergents may, be present and in an amount such as from 0.1 to 4, preferably 1.5 to 3, mass %, and function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amount of a metal base by reacting an excess of a metal compound such as an oxide or hydroxide with an acid gas such as carbon dioxide. The resulting overbased detergent comprises neutralized detergents as the outer layer of a metal base (e.g., carbonate) micelle. Such overbased detergents may have a TBN of 150 or greater, and typically from 250 to 450 or more.

Known detergents include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly preferred metal detergents are neutral and overbased calcium sulfonates having TBN of from 20 to 450 TBN, and neutral and overbased calcium phenates and sulfurized phenates having TBN of from 50 to 450.

Also, salicylates may have some advantage, if a detergent is used, since they may be substantially sulfur-free.

The lubricating oil compositions of the invention can be used in the formulation of crankcase lubricating oils (i.e., passenger car motor oils, heavy duty diesel motor oils, and passenger car diesel oils) for spark-ignited and compression-ignited reciprocating internal combustion engines. They are particularly suitable to use in engines equipped with exhaust gas-after treatment systems; thus, their low P, and possibly low S, content reduces deleterious effects on the performance of such systems when, for example, in the form of catalytic systems. The additional additives listed below are typically used in such amounts so as to provide their normal attendant functions and may optionally also be present in the oils of this invention. Typical amounts for individual components are also set forth below. All the values listed are stated as mass per cent active ingredient.

| ADDITIVE | MASS % (Broad) | MASS % (Preferred) |
|---|---|---|
| Corrosion Inhibitor | 0–5 | 0–1.5 |
| Anti–oxidant | 0–5 | 0.01–3 |
| Pour Point Depressant | 0.01–5 | 0.01–1.5 |
| Anti–foaming Agent | 0–5 | 0.001–0.15 |
| Supplemental Anti–wear Agents | 0–1 | 0–0.5 |
| Friction Modifiers | 0–5 | 0–1.5 |
| Viscosity Modifier | 0.01–20 | 0–15 |
| Synthetic and/or Mineral Base Stock | Balance | Balance |

Rust inhibitors selected from the group consisting of nonionic polyoxyalkylene polyols and esters thereof, polyoxyalkylene phenols, and anionic alkyl sulfonic acids may be used.

Copper and lead-bearing corrosion inhibitors may be used, but are typically not required with the formulation of the present invention. Typically such compounds are thiadiazole polysulfides containing from 5 to 50 carbon atoms, their derivatives and polymers thereof. Derivatives of 1,3,4 thiadiazoles, such as those described in U.S. Pat. Nos. 2,719,125; 2,719,126; and 3,087,932, are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are preferably present in an amount not exceeding 0.2 mass % active ingredient.

Oxidation inhibitors or antioxidants reduce the tendency of base stocks to deteriorate in service, which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, alkyl-substituted diphenylamine, alkyl-substituted phenyl and naphthylamines, phosphorus esters, metal thiocarbamates, ashless thiocarbamates and oil soluble copper compounds as described in U.S. Pat. No. 4,867,890. Most preferred are the alkyl-substituted diphenylamines.

Pour point depressants, otherwise known as lube oil flow improvers, lower the minimum temperature at which the fluid will flow or can be poured. Such additives are known. Typical of those additives which improve the low temperature fluidity of the fluid are $C_8$ to $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

A small amount of a demulsifying component may be used. A particularly suitable demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

The viscosity modifier (VM) functions to impart high and low temperature operability to a lubricating oil. The VM used may have that sole function, or may be multifunctional.

Some of the above-mentioned additives can provide a multiplicity of effects; thus for example, a single additive may act as a dispersant-oxidation inhibitor.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature.

Preferably, all of the additives except for the viscosity modifier and the pour point depressant are blended into a concentrate or additive that is subsequently blended into base stock to make the finished lubricating oil composition (or lubricant). The concentrate will typically be formulated to contain the additive(s) in proper amounts to provide the desired concentration in the final formulation when the concentrate is combined with a predetermined amount of a base oil.

The concentrate is preferably made in accordance with the method described in U.S. Pat. No. 4,938,880. That patent describes making a pre-mix of ashless dispersant and metal detergents that is pre-blended at a temperature of at least 100° C. Thereafter, the pre-mix is cooled to at least 85° C. and the additional components are added.

The final crankcase lubricating oil formulation may employ from 2 to 20 preferably 4 to 18, most preferably 5 to 17, mass % of the concentrate or additive package, the remainder being base stock.

What is claimed is:

1. A lubricating oil composition comprising (A) an oil of lubricating viscosity, in a major amount;

(B) a nitrogen-containing lubricating oil dispersant, in a minor amount;

(C) a nitrogen-free lubricating oil dispersant, in a minor amount;

(D) a metal dihydrocarbyl dithiophosphate, in a minor amount;

(E) a hydrocarbyl-substituted carboxylic acid or derivative thereof, in a minor amount; and (F) a metal detergent, in a minor amount, wherein the mass:mass ratio of (B) to (C) in the composition is 0.4:1 or greater, and the composition contains 0.075 or less mass % of phosphorus, expressed as elemental phosphorus.

2. The composition as claimed in claim 1 wherein the metal dihydrocarbyl dithiophosphate, (D), is a zinc dialkyl dithiophosphate.

3. The composition as claimed in claim 1 wherein the metal detergent, (F), is a neutral or an overbased alkaline earth metal detergent in which the surfactant is a salicylate, phenate or sulfonate, or mixtures thereof.

4. The composition as claimed in claim 3 wherein the detergent is a salicylate.

5. A method of lubricating an internal combustion engine equipped with an exhaust gas after-treatment system which comprises supplying to the engine a lubricating oil composition as claimed in claim 1.

6. The lubricating oil composition of as claimed in claim 1 wherein the nitrogen-containing lubricating oil dispersant is present in an amount of from 1.5 to 2 mass %, based on the total mass of the lubricating oil composition.

7. The lubricating oil composition of as claimed in claim 1 wherein the nitrogen-free lubricating oil dispersant is present in an amount of from 1 to 1.5 mass %, based on the total mass of the lubricating oil composition.

8. The lubricating oil composition of as claimed in claim 1 wherein the metal dihydrocarbyl dithiophosphate is present in an amount of from 0.25 to 0.8 mass %, based on the total mass of the lubricating oil composition.

9. The lubricating oil composition of as claimed in claim 1 wherein the hydrocarbyl-substituted carboxylic acid or derivative is present in an amount of from 0.25 to 0.8 mass %, based on the total mass of the lubricating oil composition.

10. The lubricating oil composition of as claimed in claim 1 wherein the metal detergent is present in an amount of from 0.1 to 4 mass %, based on the total mass of the lubricating oil composition.

11. A lubricating oil composition of as claimed in claim 1 containing 0.06 mass % or less of phosphorus, based on the total mass of the lubricating oil composition.

12. A lubricating oil composition of as claimed in claim 11 containing 0.05 mass % or less of phosphorus, based on the total mass of the lubricating oil composition.

13. The lubricating oil composition as claimed in claim 3 wherein said alkaline earth metal is selected from Ca and Mg.

14. The composition as claimed in claim 1 wherein the nitrogen-free dispersant, (C), comprises an alkyl succinic acid ester of an alcohol that has from 1 to 20 carbon atoms and from 1 to 6 hydroxy groups.

15. A method of improving the fluoroelastomer compatibility of a lubricating oil composition containing a minor amount of dispersant and 0.075 mass % or less of phosphorus, expressed as elemental phosphorus, which method comprises selecting as said dispersant, a combination of (B) a nitrogen-containing lubricating oil dispersant and (C) a nitrogen-free lubricating oil dispersant, in a mass:mass ratio of (B) and (C) of at least 0.4:1, and providing a minor amount of (E) a hydrocarbyl-substituted carboxylic acid, or a derivative thereof.

* * * * *